US005504385A

United States Patent [19]

Jin et al.

[11] Patent Number: 5,504,385

[45] Date of Patent: Apr. 2, 1996

[54] SPACED-GATE EMISSION DEVICE AND METHOD FOR MAKING SAME

[75] Inventors: Sungho Jin, Millington; Gregory P. Kochanski, Dunellen; John Thomson, Jr., Spring Lake, all of N.J.

[73] Assignee: AT&T Corp., Murray Hill, N.J.

[21] Appl. No.: 299,470

[22] Filed: Aug. 31, 1994

[51] Int. Cl.[6] ..... H01J 1/30

[52] U.S. Cl. ..... 313/310; 313/306; 313/309; 315/169.3; 445/24

[58] Field of Search ..... 313/306, 309, 313/310, 336, 444; 315/169.3, 169.4; 251/773; 445/24

[56] References Cited

U.S. PATENT DOCUMENTS

| | | | |
|---|---|---|---|
| 4,857,161 | 8/1989 | Borel et al. | 313/309 |
| 4,940,916 | 7/1990 | Borel et al. | 313/306 |
| 4,943,343 | 7/1990 | Bardai et al. | 313/309 |
| 5,129,850 | 7/1992 | Kane et al. | 445/24 |
| 5,138,237 | 8/1992 | Kane et al. | 315/349 |
| 5,150,019 | 9/1992 | Thomas et al. | 313/336 |
| 5,278,475 | 1/1994 | Jaskie et al. | 315/169.3 |
| 5,283,500 | 2/1994 | Kochanski | 315/58 |

OTHER PUBLICATIONS

Dec. 1991 issue of Semiconductor International, Flat Panel Displays What's All the Fuss About, by Ron Iscoff.

C. A. Spindt et al, "Field–Emitter Arrays for Vacuum Microelectronics", *IEEE Transactions On Electron devices* vol. 38(10), pp. 2355–2363 (1991).

J. A. Castellano, us "Handbook Of Display Technology", Academic Press, New York, pp. 254–257, (1992).

P. W. Hawkes, *Advances in Electronics and Electron Physics,* Academic Press, New York, vol. 83, pp. 75–85 and p. 107.

S. M. Sze, *VLSI Technology,* McGraw Hill, New York, 1988, p. 155 and p. 165.

*Primary Examiner*—Donald J. Yusko
*Assistant Examiner*—Michael Day
*Attorney, Agent, or Firm*—Glen E. Books

[57] ABSTRACT

In accordance with the invention, a field emission device is made by disposing emitter material on an insulating substrate, applying a sacrificial film to the emitter material and forming over the sacrificial layer a conductive gate layer having a random distribution of apertures therein. In the preferred process, the gate is formed by applying masking particles to the sacrificial film, applying a conductive film over the masking particles and the sacrificial film and then removing the masking particles to reveal a random distribution of apertures. The sacrificial film is then removed. The apertures then extend to the emitter material. In a preferred embodiment, the sacrificial film contains dielectric spacer particles which remain after the film is removed to separate the emitter from the gate. The result is a novel and economical field emission device having numerous randomly distributed emission apertures which can be used to make low cost flat panel displays.

9 Claims, 3 Drawing Sheets

4 μm

SPACED-GATE EMISSION DEVICE AND METHOD FOR MAKING SAME

FIELD OF THE INVENTION

This invention pertains to field emission devices and, in particular, to economical field emission devices particularly useful in displays.

BACKGROUND OF THE INVENTION

A field emission device emits electrons in response to an applied electrostatic field. Such devices are useful in a wide variety of applications including displays, electron guns and electron beam lithography. A particularly promising application is the use of field emission devices in addressable arrays to make flat panel displays. See, for instance, the December 1991 issue of *Semiconductor International.*, p. 11. C. A. Spindt et al., *IEEE Transactions on Electron Devices,* Vol. 38(10), pp. 2355–2363 (1991), and J. A. Castellano, *Handbook of Display Technology,* Academic Press, New York, pp. 254–257, (1992), all of which are incorporated herein by reference.

Conventional electron emission flat panel displays typically comprise a flat vacuum cell having a matrix array of microscopic field emitter cathode tips formed on one plate of the cell ("the back-plate") and a phosphor-coated anode on a transparent front plate. Between cathode and anode is a conductive element called a "grid" or "gate". The cathodes and gates are typically perpendicular strips whose intersections define pixels for the display. A given pixel is activated by applying voltage between the cathode conductor strip and the gate conductor strip whose intersection defines the pixel. A more positive voltage is applied to the anode in order to impart a relatively high energy (about 1000 eV) to the emitted electrons. See, for example, U.S. Pat. Nos. 4,940,916; 5,129,850; 5,138,237; and 5,283,500.

A difficulty with these conventional flat panel displays is that they are difficult and expensive to make. If conventional approaches the gate conductors typically have important micron or submicron features which require expensive, state-of-the-art lithography. Accordingly, there is a need for an improved electron emission apparatus which can be economically manufactured for use in flat panel displays.

SUMMARY OF THE INVENTION

In accordance with the invention, a field emission device is made by disposing emitter material on an insulating substrate, applying a sacrificial film to the emitter material and forming over the sacrificial layer a conductive gate layer having a random distribution of apertures therein. In the preferred process, the gate is formed by applying masking particles to the sacrificial film, applying a conductive film over the masking particles and the sacrificial film and then removing the masking particles to reveal a random distribution of apertures. The sacrificial film is then removed. The apertures then extend to the emitter material. In a preferred embodiment, the sacrificial film contains dielectric spacer particles which remain after the film is removed to separate the emitter from the gate. The result is a novel and economical field emission device having numerous randomly distributed emission apertures which can be used to make low cost flat panel displays.

BRIEF DESCRIPTION OF THE DRAWINGS

The nature, advantages, and various additional features of the invention will appear more fully upon consideration of the illustrative embodiments now to be described in detail in connection with the accompanying drawings. In the drawings.

DETAILED DESCRIPTION

Figure 1:
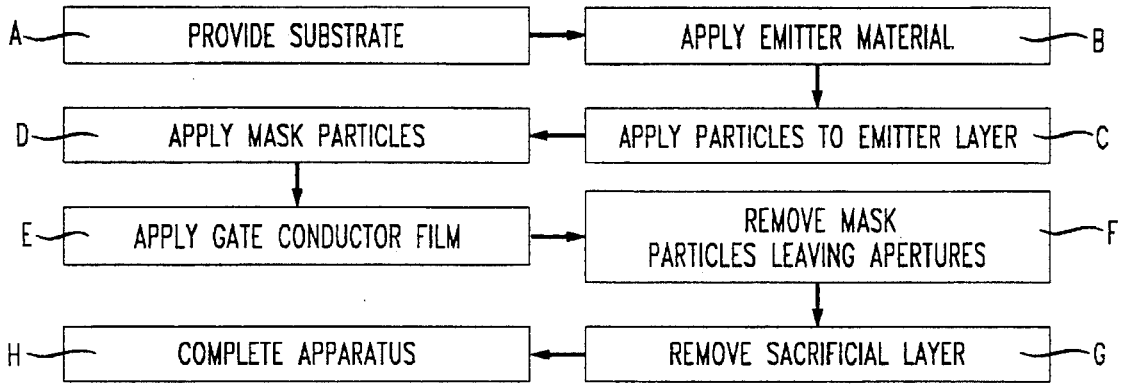
FIG. 1 is a flow diagram of an improved process for making a field emission device.

Referring to the drawings, FIG. 1 is a schematic flow diagram of an improved process for making a field emission device. The first step, shown in block A, is to provide a substrate. If the finished device is intended for use in a display, the substrate preferably comprises a material such as glass, ceramic or silicon that can be joined with other materials to form a vacuum-sealed structure. Alternatively, an additional glass backplate can be placed underneath the substrate for sealing.

The next step shown in block B of FIG. 1 is to apply to the substrate a layer of emitter material. Advantageously, the emitter material is applied in a desired pattern. An emitter material is a conductive or semiconductive material having many points, such as sharp peaks, for field-induced emission of electrons. The peaks can be defined by known etching techniques or can be the result of embedding sharp emitter bodies in a matrix.

The emitter material can be chosen from a number of different materials that can emit electrons at relatively low applied electric fields, typically less than 50 volts/micron of distance between the emitter and the gate electrode and preferably less than 25 V/μm so that the industrially desirable CMOS type circuit drive can be used. Even more preferably the material emits electrons at less than 15 V/μm. Exemplary materials suitable as emitters include diamonds (either chemical vapor deposited, natural diamond grits, or synthetic diamonds, doped or undoped), graphite, metals such as Mo, W, Cs, compounds such as $LaB_6$, $YB_6$, AlN, or combinations of these materials and other low work function materials deposited as a film. Desirable emitter geometry includes sharp-tipped, jagged, flaky or polyhedral shape, either periodically arranged or randomly distributed, so that the field concentration at the sharp tips can be utilized for low voltage operation of electron emission. Since multiple emitting points are desired for each pixel, a continuous film or layer of material with multiple sharp points or a multiplicity of polyhedral particles can be used. Materials with negative or low electron affinity, such as some n-type diamonds, emit electrons relatively easily at low applied voltages and thus may not require sharp tips for field concentration.

The emitter material itself is typically made conductive as by mixing emitter bodies in a conductive slurry or paste such as silver-epoxy, low-melting point solder, or mixture of conductive metal particles. Particles of low-melting point glass can be added to promote heat-induced adhesion, and particles of easily reduced oxides, such as copper oxide, can be added to provide the glass with conductivity upon reduction in hydrogen. The conductive particle volume should exceed the percolation limit and is advantageously at least 30% and preferably at least 45%.

In the preferred approach, the layer of emitter material is applied to the substrate in a desired pattern by applying a conductive paste of the emitter material by screen printing or spray coating through a mask. Typically the desired pattern will be a series of parallel stripes. After application and patterning, the layer is dried, baked and, if desired, subjected to hydrogen or forming gas heat treatment to enhance conductivity. The layer can also be applied as a continuous layer and, if patterning is desired, patterned using conventional lithography.

Alternatively, emitter particles are distributed on a patterned conductive material to which they chemically react to form a strong bond. Exemplarily, titanium electrodes in the form of stripes could be deposited, then graphite is sprinkled across the surface. When the substrate is then baked in a reducing atmosphere, the graphite binds strongly to the stripes.

Figure 2:
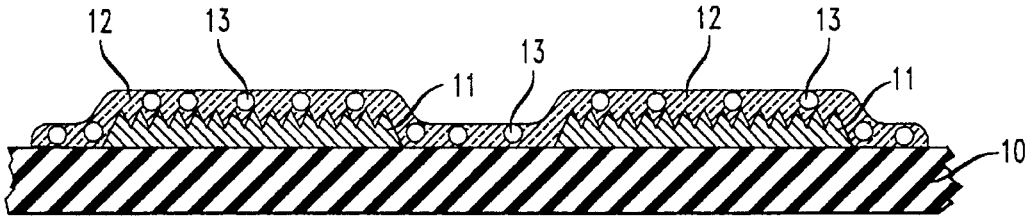
FIGS. 2–4 are schematic cross sections of a field emission device at various stages of fabrication.

The third step, shown in block C of FIG. 1 is to apply to the emitter layer a sacrificial layer such as polymethylmethacrylate (PMMA) and a suitable solvent. Preferably the sacrificial layer also contains dielectric spacer particles such as alumina particles of 0.1 to 2 μm size. The resulting structure shown in FIG. 2 comprises a substrate 10, emitter layer 11 and sacrificial layer 12 containing dielectric spacer particles 13. The film 12 is deposited so that, after drying, the particle 13 sizes are typically slightly larger than the mean PMMA thickness. Typically, the volume fraction of particles in the completed film would be 0.5% to 50% and preferably 2–20%. Alternative materials for layer 12 include water soluble polymers and soluble inorganic salts. The film 12 could even be composed of very small particles (typically less than 10% of the size of the spacer particles), so long as some physical or chemical means of removing the sacrificial film, is available, without damage to other device structures. If the gate is sufficiently narrow, spacer particles may be unnecessary.

Figure 3:
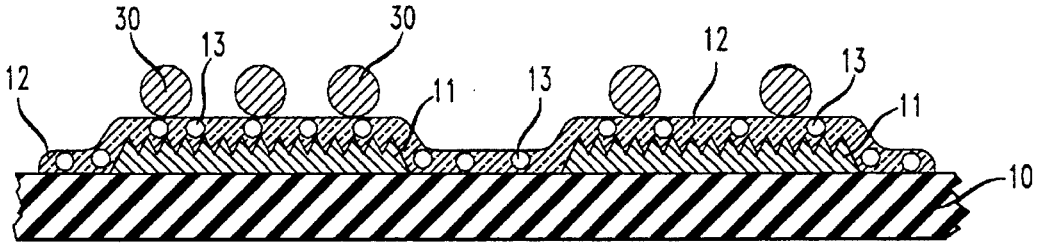

The next step is to form over the sacrificial layer a conductive gate layer having a random distribution of apertures therein. The preferred approach, as shown in block D of FIG. 1, is to apply to the sacrificial layer, masking particles to be used in creating a perforated gate structure. FIG. 3 shows the resulting structure with masking particles 30 disposed on sacrificial layer 12. The masking particles 30 may be chosen from a number of materials such as metals (e.g., Al, Zn, Co, Ni), ceramics (e.g., $Al_2O_3$, MgO, NiO, BN), polymers (e.g., latex spheres) and composites. Typical desirable particle size is 0.1–100 μm, and preferably 0.2–5 μm. The particles may be spherical or randomly shaped. The particles are conveniently applied onto the surface of the sacrificial layer 12 by conventional particle dispensing techniques such as spray coating, spin coating or sprinkling. The particles may be mixed with volatile solvents such as acetone or alcohol (for spray coating) to improve adhesion on the surface at the sacrificial layer.

One particularly advantageous technique is to deposit the particles electrostatically. The particles can be dry sprayed from a nozzle at a high voltage. As they leave the nozzle, they will acquire an electric charge, and will thus repel one another, as well as be attracted to the sacrificial layer 12. The mutual repulsion of the mask particles will produce a more uniform but nonetheless essentially random spacing across the layer 12, and thus allow a higher density of mask particles without exceeding the percolation limit and thus rendering the gate nonconductive. It is particularly advantageous to use dielectric mask particles, as they will retain some of their charge even after landing on layer 12, and will thus force incoming particles into areas with a low density of previous mask particles.

The fifth step (block E) is to apply a film of conductive material over the sacrificial layer to act as a gate conductor. The gate conductor material is typically chosen from metals such as Cu, Cr, Ni, Nb, Mo, W or alloys thereof, but the use of highly conductive non-metallic compounds such as oxides (e.g., Y-Ba-Cu-O, La-Ca-Mn-O), nitrides, carbides is not prohibited. The desirable thickness of the gate conductor is 0.05–10 μm and preferably 0.2–5 μm. The mask particles 30 protect the underlying regions of sacrificial layer 12. The gate conductor film is preferably formed into a pattern of stripes perpendicular to the stripes of the electron emitting layer. The regions of intersection between the stripes of the emitter layer and the stripes of the gate conductor layer will form an addressable array of electron sources.

Figure 4:
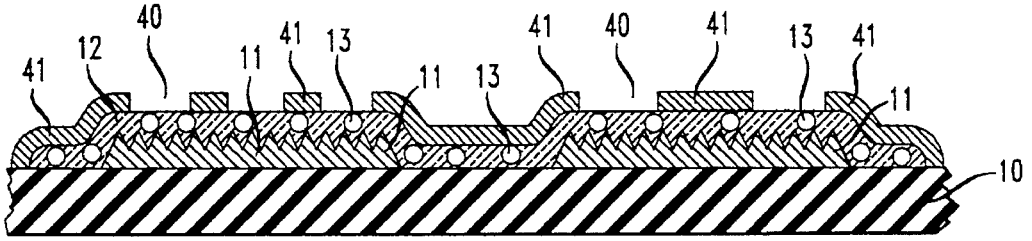

The next step (block F) is to remove the mask particles, exposing the underlying sacrificial layer 12. The mask particles can be removed by brushing, as with an artist's paint brush, to expose the sacrificial layer beneath the particles. If magnetic mask particles are used they can be removed by magnetic pull. The resulting structure with conductive layer 41 having exposed aperture portions 40 is shown in FIG. 4. Because of the random mask particle distribution, the resultant gate apertures 40 also have random distribution rather than the typically periodic distribution as in photolithographically created gate apertures. The preferred size of the gate perforation is 0.1–50 μm, preferably 0.2–5 μm in diameter. The fraction of the perforation is desirably at least 5% and preferably at least 20% while remaining below the percolation threshold so that the gate remains continuous. A large number of gate apertures per pixel is desired for the sake of display uniformity. The number of the apertures is at least 50, and preferably at least 200 per pixel.

Figure 5:
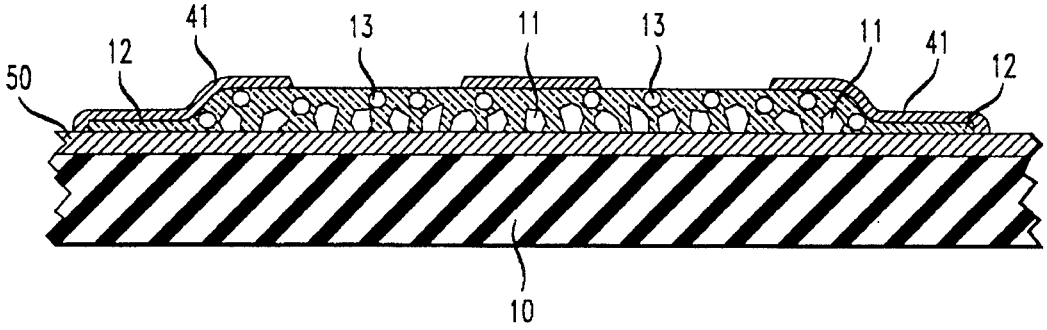
FIG. 5 shows an alternative embodiment of the FIG. 4 structure.

FIG. 5 illustrates an alternative form of the structure after step F where the emitter layer 11 is discontinuous (or non-conductive) and has been applied on a conductive layer 50 for providing current to the emitter points. The conductive layer can be applied to substrate 10 in a step preliminary to the application of emitter layer 11. The discontinuous emitter particles may be prepared by thin film processing such as chemical vapor deposition or by screen printing or spray coating of electron emitting particles such as diamond or graphite.

In the next step shown in block G of FIG. 1, the sacrificial layer 12 is removed. If dielectric spacer particles 13 are used, the sacrificial layer should be removed without disturbing the spacer particles. In the preferred embodiment, the PMMA is heated to approximately 300° C. in an inert atmosphere, so that it depolymerizes and evaporates. Other sacrificial layers require other processing techniques, such as solution in water.

Figure 6:
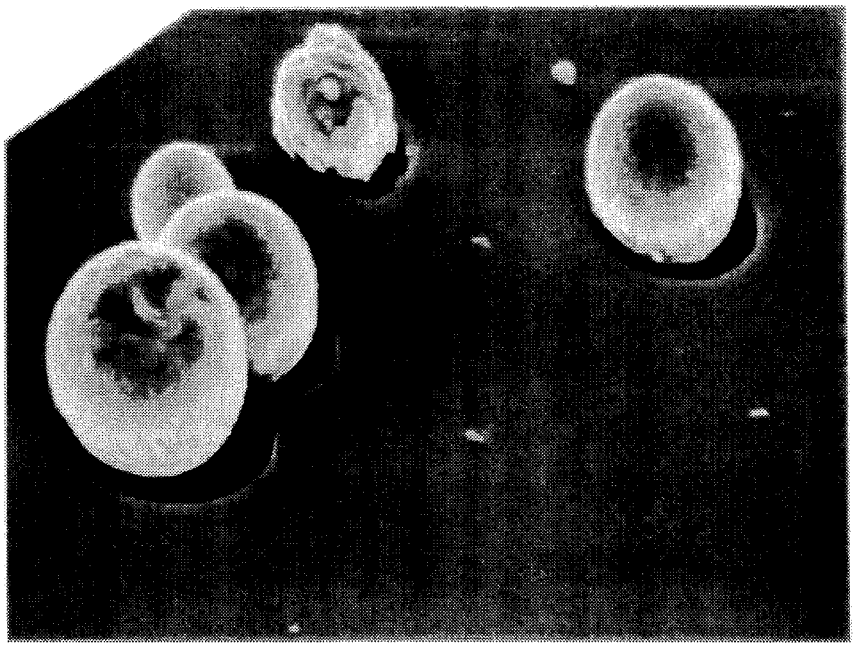
FIGS. 6 and 7 are scanning electron micrographs illustrating the masking effect of particles useful in the process of FIG. 1.
Figure 7:
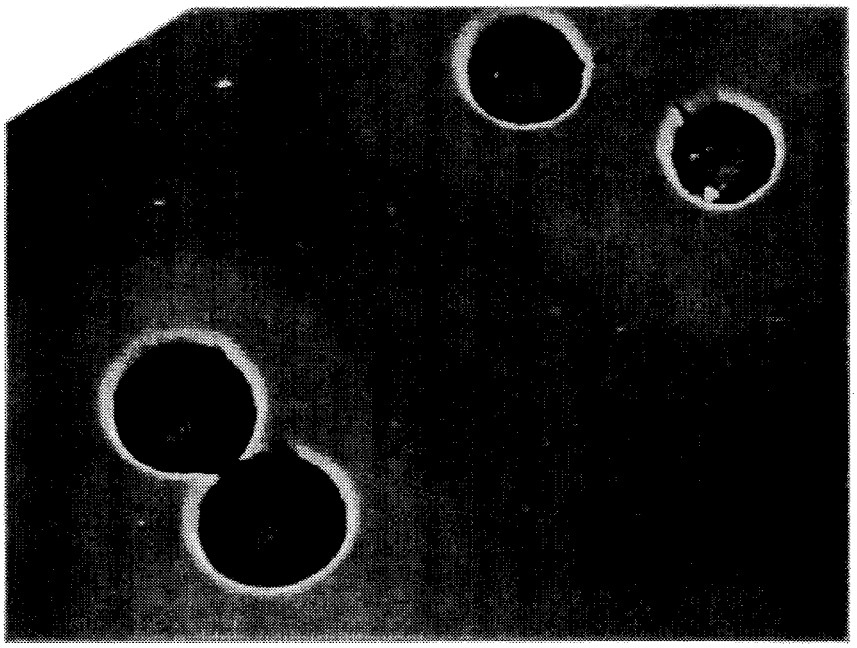

Shown in FIGS. 6 and 7 are exemplary scanning electron microscopy (SEM) photomicrographs of the masked structure taken at a magnification of about X4500. Fine aluminum particles were mixed with acetone and spray coated on glass substrate and the solvent was allowed to dry off. The glass substrate partially covered with the mask particles was then coated with a 1 μm thick Cu film by thermal evaporation deposition using a Cu source. FIG. 6 shows the SEM micrograph of the substrate with the mask particles after the Cu film has been deposited. Because of the shadowy effect, the areas of the substrate beneath the mask particles are not coated with the conductor. FIG. 7 shows that after gently brushing off the particles using an artist brush, only the randomly distributed holes (2–4 μm size) are left. Such fine-scale perforated metal layers are suitable as a multi-channel gate structure. Thus, a perforated gate structure with micron-level apertures is produced without using costly photolithographic processing.

For display applications emitter material (the cold cathode) in each pixel of the display desirably consists of multiple electron-emitting points for the purpose, among other things, of averaging out and ensuring uniformity in display quality. Since efficient electron emission at low applied voltages is typically achieved by the presence of the accelerating gate electrode in close proximity (typically about micron level distance), it is desirable to have multiple gate apertures over a given emitter body to maximally utilize the capability of multiple electron emission source. For example, each (100 μm) square pixel in a field emission device can contain thousands of graphite flakes per pixel. It is desirable to have a fine-scale, micron-size gate structure with as many gate apertures as possible for maximum emission efficiency. Advantageously, the gate apertures have a diameter approximately equal to the emitter-gate spacing.

The final step (block H of FIG. 1 ) is to complete the fabrication of the electron emitting device in the conventional fashion. This generally involves forming an anode and disposing it in spaced relation from the cold cathode emitting material within a vacuum seal. In the case of a flat panel display completion involves making the structure of FIG. 8 which shows an exemplary flat panel display using a device prepared by the process of FIG. 1. Specifically, an anode conductor 80 formed on a transparent insulating substrate 81 is provided with a phosphor layer 82 and mounted on a support pillar 83 in spaced relation from the device of FIG. 4 or FIG. 5 (after removal of the respective sacrificial layers). The space between the anode and the emitter is sealed and evacuated and voltage is applied by power supply 84. The field-emitted electrons from the activated cold cathode electron emitters 11 are accelerated by the perforated gate electrode 41 from the multiple apertures 40 on each pixel and move toward the anode conductor layer 80 (typically transparent conductor such as indium-tin-oxide) coated on the anode substrate 81 (advantageously a glass face plate). Phosphor layer 82 is disposed between the electron emitter apparatus and the anode. As the accelerated electrons hit the phosphor, a display image is generated. The phosphor layer 82 can be deposited on the anode conductor 80 using the known TV screen technology.

Figure 8:
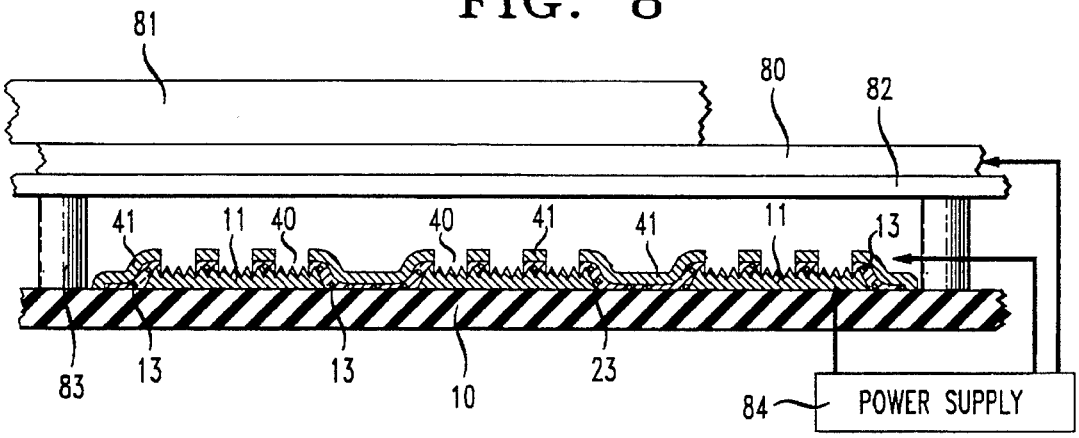
FIG. 8 is a cross sectional view of a flat panel display using a field emission device made by the process of FIG. 1.
Figure 9:
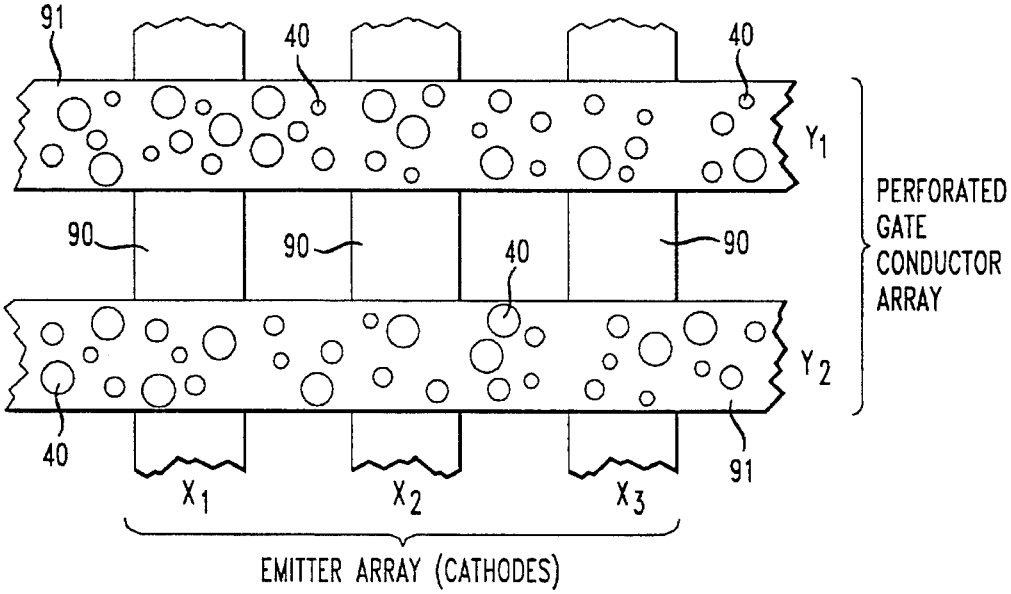
FIG. 9 is a schematic top view of the field emission device used in the display of FIG. 8.

FIG. 9 illustrates the columns 90 of the emitter array and the rows 91 of the gate conductor array to form an x-y matrix display in the device of FIG. 8. These rows and columns can be prepared by low-cost screen printing of emitter material (e.g., with 100 μm width), and physical vapor deposition of the gate conductor through a strip metal mask with a 100 μm wide parallel gaps. Depending on the activation voltage of a particular column of gate and a particular row of emitter, a specific pixel is selectively activated to emit electrons and activate the phosphor display screen above that pixel.

In addition to the simplicity, low cost, and reduced environmental wastes associated with the elimination of fine-line lithography, the particle-mask technique of FIG. 1 offers an advantage of providing conformal deposition of dielectric and gate conductor films regardless of the real-life variations in emitter height or width. For example, the emitter body may be constructed by a low-cost, screen-printing or spray-coating process using a mixture of diamond particles (for field emission), metal or conductive particles (for conducting electricity), glass frits (for partial or complete melting for adhesion to the glass backplate), organic binder (for viscosity control during screen printing) and solvent (for dissolution of the binder). If the screen printed and cured emitter strips have a dimension of 50 μm height and 100 μm width, it is reasonable to anticipate a dimensional variation of at least 1–5 μm, e.g., in height. In view of the desirable gate-emitter distance of about 1 μm level or smaller, such a height variation in emitter is not acceptable from the product reliability aspect unless the gate structure can be made conformal and maintains the 1 μm level distance. The present invention encompasses such a desirable feature.

The inventive process of creating the micron-level, perforated gate structure described above is only an example of many possible variations in processing, structure, and configuration. For example, the deposition of sacrificial film and the gate conductor film can be repeated more than once to create multi-layered gate apertures for the purpose of shaping the trajectories of the emitted electron beam or for triode operation. Yet in another example, the mask particles can be placed after the gate conductor films are already deposited, and then a suitable etch-blocking mask material (polymeric or inorganic material that are resistance to acid) can be deposited over the mask particles by evaporation or spray coating, and then the mask particles are brushed away. The regions not covered by the etch-blocking mask layer are then etched away. For example, a metallic gate conductor film such as Cr can be etched with nitric acid to create the gate apertures and the sacrificial dielectric with hydrofluoric and/or other physical technical means, to expose the underlying emitter material. The etch-blocking mask is then removed, e.g., by solvent, or thermal desorption.

The inventive apparatus can also be useful for a variety of devices including flat panel display, electron beam guns, microwave power amplifier tubes, ion source, and as a matrix-addressable source for electrons for electron-lithography. (See, P. W. Hawkes, "Advances in Electronics and Electron Physics", Academic Press, New York, Vol. 83, pp. 75–85 and p. 107, (1992). In the latter device, the activation of selected rows and columns would provide emitted electrons from specific, predetermined pixels, thus achieving selective etching of electron-sensitive lithography resist material (such as polymethyl methacrylate (PMMA) for patterning, for example, of ultra high-density circuits. This feature is advantageous over the conventional electron beam lithography apparatus which typically achieves pattern writing using scanning procedure and hence the throughput is much less, as described in "VLSI Technology" by S. M. Sze, McGraw Hill, New York, 1988, p. 155 and p. 165.

The inventive apparatus, when used as matrix addressable ion source apparatus, emits electrons from activated pixel areas which impact ambient gas molecules and cause ionization.

While specific embodiments of the present invention are shown and described in this application, this invention is not limited to these particular forms. The invention also applies to further modifications and improvements that do not depart from the spirit and scope of this invention.

We claim:

1. A field emission device comprising:

a substrate supported layer of electron emitting material;

means for electrically contacting said electron emitting material;

a conductive layer overlying said electron emitting material and spaced from said electron emitting material by a plurality of dielectric spacer particles, said conductive layer containing a random distribution of apertures to said electron emitting material.

2. A field emission device according to claim 1 wherein said spacer particles have a size predominantly in the range 0.1 to 2 micrometers.

3. A field emission device according to claim 1 wherein said conductor layer has a thickness in the range 0.2 to 5 micrometers.

4. A field emission device according to claim 1 wherein said apertures form a perforation fraction in the conductive layer of at least 5% but remaining below the percolation threshold.

5. A field emission device according to claim 1 wherein said electron emitting material is a material selected from the group consisting of diamond, graphite, Mo, W, Cs, $L_aB_6$, $YB_6$, or AIN.

6. A field emission device according to claim 1 wherein said layer of electron emitting material and said layer of conductive material are patterned to define a plurality of addressable intersecting regions.

7. A display device comprising a field emission device according to claim 1 or claim 2 or claim 3 or claim 4 or claim 5 or claim 6.

8. In a flat panel display device of the type comprising a vacuum cell having an array of field emitter cathodes on the back-plate of the cell and a phosphor-coated anode on a transparent front plate, one or more conductive gate layers disposed between said anodes and said cathodes, said cathodes and gates formed into patterns for defining pixels for the display, the improvement wherein:

said gate layer is spaced from said field-emitter cathodes by a plurality of dielectric particles and said gate layer contains a random distribution of perforations predominantly in the range 0.1 to 50 micrometers in diameter for providing apertures to said field emitter cathodes.

9. The improved flat panel display of claim 8 wherein the portion of the gate layer defining a pixel has at least 50 random perforations in the range 0.1 to 50 micrometers in diameter.

* * * * *